282-146 AU 166 EX
5/3/83 XP 4,381,950

United States Patent [19]
Lawson

[11] 4,381,950
[45] * May 3, 1983

[54] METHOD FOR REMOVING IRON SULFIDE SCALE FROM METAL SURFACES

[75] Inventor: Michael B. Lawson, Duncan, Okla.

[73] Assignee: Halliburton Company, Duncan, Okla.

[ * ] Notice: The portion of the term of this patent subsequent to Sep. 28, 1999, has been disclaimed.

[21] Appl. No.: 405,808

[22] Filed: Aug. 5, 1982

Related U.S. Application Data

[63] Continuation-in-part of Ser. No. 266,266, May 22, 1981, Pat. No. 4,351,673.

[51] Int. Cl.[3] ..... C23G 1/08
[52] U.S. Cl. ..... 134/3; 134/41; 252/142; 252/146
[58] Field of Search ..... 134/3, 41; 252/8.55 B, 252/142, 146, 148, 149, 151; 562/594

[56] References Cited

U.S. PATENT DOCUMENTS

| | | | |
|---|---|---|---|
| 1,873,083 | 8/1932 | Walker | 252/8.55 B |
| 3,399,230 | 8/1968 | Campbell | 562/594 |
| 3,794,523 | 2/1974 | Thompson | 134/3 |
| 4,147,647 | 4/1979 | Rybacki | 252/8.55 B X |
| 4,220,550 | 9/1980 | Frenier et al. | 134/41 X |
| 4,276,185 | 6/1981 | Martin | 252/8.55 B X |
| 4,289,639 | 9/1981 | Buske | 134/41 X |

FOREIGN PATENT DOCUMENTS

| | | | |
|---|---|---|---|
| 53-2351 | 1/1978 | Japan | 134/41 |

*Primary Examiner*—Marc L. Caroff
*Attorney, Agent, or Firm*—Robert A. Kent; Thomas R. Weaver

[57] ABSTRACT

A process for reducing hydrogen sulfide gas evolution during dissolution of ferrous sulfide with an aqueous acidic solution comprising contacting the ferrous sulfide with an aqueous acidic solution containing an effective amount of an additive comprising at least one member selected from the group consisting of maleic acid, maleic anhydride and the alkali metal and ammonium salts of maleic acid. The aqueous acidic solution also can contain corrosion inhibitors.

16 Claims, No Drawings

METHOD FOR REMOVING IRON SULFIDE SCALE FROM METAL SURFACES

This application is a continuation-in-part of application Ser. No. 266,226 filed May 22, 1981, now U.S. Pat. No. 4,351,673, entitled "Method for Removing Iron Sulfide Scale from Metal Surfaces".

BACKGROUND OF THE INVENTION

1. Field of the Invention

This invention relates to a method of removing ferrous sulfide deposits from ferrous metal surfaces, and more particularly to a method for removing such deposits with an acidic solution containing a selected additive whereby the presence of free hydrogen sulfide is substantially minimized.

2. Description of the Prior Art

In many processes involving sulfur, deposits including ferrous sulfide (FeS) tend to accumulate or build upon ferrous metal surfaces such as reactor walls, piping, and other surfaces. Petroleum refineries, which process crude oil or natural gas, end up with substantial amounts of ferrous sulfide on the metal surfaces of apparatus in contact with the crude oil or gas. The ferrous sulfide which accumulates upon the ferrous metal surfaces commonly is referred to as "scale". The scale must be periodically removed from the metal surfaces in order to restore efficient operation of the scale-coated apparatus.

Numerous techniques previously have been proposed to effect the removal of ferrous sulfide. One method of removing ferrous sulfide comprises contacting the ferrous sulfide with a conventional acid cleaning solution. The acid cleaning solution reacts with the ferrous sulfide and produces gaseous hydrogen sulfide ($H_2S$).

Hydrogen sulfide gas produced during the acid cleaning of the surface containing the ferrous sulfide causes environmental and physical problems. First, hydrogen sulfide is an extremely toxic gas and cannot be directly vented to the atmosphere. In addition, hydrogen sulfide and acid cleaning solutions containing hydrogen sulfide can cause severe corrosion on ferrous metals which the solution contacts.

In an effort to avoid the problems associated with the cleaning of ferrous sulfide with an acid, inhibiting compositions of various types have been added to the acid cleaning solutions which react with the hydrogen sulfide and thus prevent the release of the hydrogen sulfide to the atmosphere. One problem associated with this method of control of hydrogen sulfide generation is that many times precipitates form in the cleaning solution and are deposited on the surfaces which are being cleaned.

In another method of cleaning ferrous sulfide scale from metal surfaces, a chelating agent is added to the cleaning solution at a pH such that the hydrogen sulfide is not released to the atmosphere but is retained in the solution as sulfide or bisulfide ions. A major problem associated with this method of cleaning ferrous sulfide scales is that high temperatures are required for the effective operation of the chelating agent and the chelating agents are very expensive.

The present invention provides a method of removing ferrous sulfide deposits from ferrous metal surfaces which overcomes or at least mitigates the above described problems.

SUMMARY OF THE INVENTION

It has been discovered that ferrous sulfide can be removed from ferrous metal surfaces by contacting the surface with an acidic solution containing an additive comprising maleic acid or a salt thereof and by this method the amount of hydrogen sulfide evolved in the reaction is greatly diminished with the result that the ferrous sulfide is removed from the metallic surface with a minimum amount of hydrogen sulfide gas evolution.

DESCRIPTION OF THE PREFERRED EMBODIMENT

The present invention is a method for effectively removing ferrous sulfide scale from ferrous metal surfaces. The solution utilized in practicing the method broadly can be described as an aqueous acidic solution containing maleic acid or a salt thereof. Optionally, an acid corrosion inhibitor may be added to the above described composition.

The process of the invention can be broadly described as comprising contacting the ferrous sulfide scale with the described aqueous acidic solution at a temperature of from about ambient temperature of about 250° F. for a period of 1 to 24 hours.

As will be apparent from this board description, the composition used in the invention is relatively simple in constitution and is easily formulated. Moreover, the ferrous sulfide removal method proposed is operative over a wide range of temperature and time conditions, rendering it flexible and effective under a variety of cleaning conditions which may, for example, shorten the downtime of the equipment.

As a final aspect indicative of the value and utility of the present invention, the spent ferrous sulfide scale removal solution can be easily removed from vessels in which it has been used, and can be treated after removal to render disposal of waste effluence a simple, economic, and ecologically satisfactory procedure.

Having broadly alluded to the method of the invention, and cited certain salient characteristics of the composition used in the method, the subsequent description herein will be directed to a consideration of certain preferred embodiments of the invention, into a detailed description of these embodiments in conjunction with examples set forth as illustrative of typical practice of the invention and utilizing certain preferred embodiments of the invention. The aqueous acidic solutions which are utilized in the composition of the invention can comprise substantially any aqueous solution of an organic or inorganic acid which does not adversely react with the additive of the invention and is capable of dissolving ferrous sulfide. Suitable organic acids comprise, for example, acetic acid, formic acid, hydroxyacetic acid, ethylenediaminetetraacetic acid, nitrilotriacetic acid and citric acid. Suitable inorganic acids comprise, for example, hydrochloric acid, sulfuric acid, phosphoric acid and sulfamic acid. Preferably, the aqueous acidic solution comprises a solution of the ethylenediaminetetraacetic acid which is present in an amount of from about 1 percent to about 10 percent by weight of the total solution. Most preferably, the ethylenediaminetetraacetic acid is present in an amount of from about 4 percent to about 8 percent by weight of the total solution.

As has been previously stated, the active or effective component of the composition used in the invention to minimize the evolution of hydrogen sulfide gas is an additive comprising maleic acid, the di- and monoalkali metal salts of maleic acid and di- and mono ammonium salts of maleic acid. In addition, the anhydrous form of maleic acid readily may be used in place of the acid form and is properly referred to as maleic anhydride. The preferred additive is maleic acid.

The amount of additive used to carry out the method of the invention will vary greatly, depending upon the equipment and surface to be cleaned, but will vary over a wide range. Aqueous acidic solutions which contain as little as 0.01 percent by weight of the additive are effective in removing the ferrous sulfide scale and minimizing hydrogen sulfide gas evolution under some temperature conditions. The maximum amount of the additive which may be included in the aqueous acidic solution is limited only by economics and by the solubility of the selected additive compound in water. In general, the most effective and preferred concentration range of the additive in the aqueous acidic solution is from about 0.1 weight percent to about 35 weight percent. Preferably, the additive is present in the aqueous acidic solution in an amount of from about 0.1 percent to about 15 percent by weight of the total solution. When the additive employed is maleic acid, a concentration of from about 0.1 percent to about 10 percent by weight has been found to be an effective concentration. Preferably, the concentration of the maleic acid is in the range of from about 0.1 percent to about 5 percent by weight. In this range, the cleaning solution used to carry out the method of the invention substantially prevents the evolution of significant quantities of hydrogen sulfide gas.

In addition to the additive of the aqueous acidic solution of the present invention the solution preferably contains a small amount of corrosion inhibiting compound. This compound functions, in the course of the cleaning procedure, to protect the metal surface from direct attack by the cleaning solution. In some occasional metal cleaning operations, the removal of small amounts of metal from the surface being cleaned is not intolerable, but this is generally not the case, and, in general, about 0.1 weight percent or more corrosion inhibiting compound is included in the cleaning solution. An amount of 0.1 percent has usually been found to be sufficient to attain maximum corrosion inhibition. Typical corrosion inhibiting compounds which can be effectively employed in the compositions of the present invention include, but are not limited to alkyl pyridines, quaternary amine salts, and dibutylthiourea, and mixtures of these materials with each other and/or with carrier or surface active materials such as ethoxylated fatty amines. The preferred inhibitor is a mixture of N,N'-dibutylthiourea, ethylene oxide derivative of a fatty acid amine, alkyl pyridine, acetic acid, and ethylene glycol.

Although the type of water used in the aqueous acidic solution containing the active additive described above is not critical to the practice of the invention, there are many applications of the process of the invention which make it desirable on such occasions to use potable water or water which is as nearly salt free as possible such as demineralized water.

The method of the invention is carried out first by preparing the aqueous acidic solution of the invention. The solution is prepared by adding the additive to an aqueous solution or aqueous acidic solution while agitating the solution. If the acid to be utilized to remove the scale previously has not been admixed with the aqueous solution, the acid then is admixed with the aqueous solution containing the additive. The corrosion inhibitor, if desired, then is added to the composition. The pH is checked and adjusted to insure the pH is less than 7. The aqueous acidic solution can be prepared in any convenient mixing apparatus.

The unit to be cleaned is next contacted by the aqueous acidic solution of the invention. During the cleaning, temperatures in the range of about ambient temperature to about 200° F. have been found to be the most satisfactory. The treatment can be carried out outside this range such as, for example, below ambient temperature or up to a temperature of about 250° F. when the cleaning operation is performed at a pressure above atmospheric pressure. The most preferred temperature for carrying out the method of the invention is in the range of from about 150° F. to about 200° F.

Many times the temperature at which contact of the composition of the present invention with the ferrous sulfide initially is carried out will be determined by the temperature at which the vessel or other structure has been operated prior to treatment. Thus, where a vessel has been on stream, and it is desired to shut the vessel down and clean it with a minimum of off stream time, the vessel initially will be cooled down to a temperature in the upper portion of the temperature range specified. On the other hand, where a vessel or other equipment has been off stream, or has operated under relatively cool or ambient temperature conditions, the method can be carried out at the lower portion of the operative temperature range specified. The time of treatment should be sufficient to remove substantially all the scale from the vessel or metal surface and, therefore, the time that the composition must contact the vessel or the surface will depend on the nature and the thickness of the scale and the temperature at which the treatment is carried out.

When the metal to be cleaned has been brought to the appropriate temperature, the composition of the invention then is introduced into the vessel or into contact with the ferrous sulfide encrusted surface. The solution then preferably is slowly circulated with pumps so that efficient contact is maintained between the composition of the invention and the ferrous sulfide to be removed. From time to time, additional amounts of the cleaning solution of the invention can be added to the original quantity placed within the vessel or in contact with the metal so that the capacity of the solution is ultimately sufficient to accomplish this objective.

The time period over which contact is maintained between the composition of the invention and the ferrous sulfide bearing metal can vary widely. Usually, a contact time of at least one hour will be needed. The operative time periods normally employed are in the range of from about 1 hour to about 24 hours. The operative time periods which have been found preferable in most usages range from about 6 to about 12 hours. There appears to be no critical limitation on the maximum amount of time that the scale removing composition is in contact with the ferrous sulfide encrusted metal except that time considerations are, of course, very important in many applications of the invention, since extended downtime on boilers and other heat exchange equipment is directly correlative to an economic loss attributed such downtime and inoperativeness. It has been found most desirable to maintain contact between the composition of the invention and the metal to be cleaned for a period of from about 4 hours to about 8 hours.

The amount and type of corrosion inhibitor which, if desired, is included in the aqueous acidic solution is dependent upon the temperature at which the process is carried out with higher temperatures generally requiring the inclusion of a relatively large amount of corrosion inhibitor.

With respect to the pressure at which the cleaning method of the invention is carried out, the pressure is in no way critical to the operativeness of the process.

After the completion of the total contact time for the purpose of removing the ferrous sulfide scale from the metallic surface, the vessel or other structure being cleaned is cooled down to a temperature below that at which the cleaning occurred and, preferably, about 100° F., and, most preferably, ambient temperature, and the spent cleaning solution then is drained from the vessel or removed from contact with the metallic structure. The structure is rinsed with water. The spent composition of the invention then is disposed of by any suitable environmentally acceptable method.

The following example will serve to more comprehensively illustrate the principles of the invention but in being directed to certain specific compounds and process steps and conditions, is not intended to limit the bounds of the invention.

EXAMPLE

As examples of compositions of the present invention several solutions were prepared in which different quantities of maleic acid was admixed with aqueous solutions of ethylenediaminetetraacetic acid (EDTA) and the resulting solutions were used to dissolve iron sulfide.

In a typical experimental test, 100 milliliters of the aqueous acidic solution was placed in a 4-ounce glass bottle. The bottle was sealed with a rubber stopper provided with two glass tubes which penetrated the stopper to permit subsequent purging of the solution in the bottle with nitrogen gas. The bottle then was placed in a thermostatically controlled water bath for about 45 minutes to permit the solution to reach thermal equilibrium. After thermal equilibrium was achieved, the bottle was removed from the water bath and a weighed coupon comprising 1020 mild steel and 2.0 grams of acid soluble iron sulfide (FeS) was added to the bottle. The bottle then was resealed and returned to the water bath. The bottle was connected to a scrubbing flask by one of the glass tubes penetrating the stopper. The scrubbing flask contained 150 milliliters of 25 weight percent sodium hydroxide solution to effect removal of any hydrogen sulfide gas generated during the test from the off gases vented from the bottle. A source of nitrogen gas was connected to the remaining tube in the stoppered bottle.

The bottle and its contents were maintained in the water bath for about 6 hours after which it was removed and purged with nitrogen gas for about 30 minutes to remove any hydrogen sulfide gas dissolved in the solution. The nitrogen gas was discharged from the glass bottle through the scrubbing flask. The aqueous acidic solution was filtered and analyzed by standard analytical techniques to determine the Fe ion and sulfide content of the solution. The caustic solution contained in the scrubber also was analyzed for sulfide content. The total sulfide emission from the dissolution of the acid-soluble iron sulfide metal coupon is determined by summing the sulfide content of the aqueous acidic solution and the caustic solution. The corrosion rate of the metal coupon was calculated from the weight loss of the coupon. The iron content of the test solution resulting from dissolution of the acid-soluble iron sulfide was calculated by subtraction of the iron dissolved from the coupon from the total iron content of the aqueous acidic solution. The results of the experimental tests are set forth in the table below.

TABLE

Hydrogen Sulfide Gas Suppression Using Aqueous Acidic Solution Containing Maleic Acid

| Test No. | Aqueous Acidic Solution EDTA Concentration, (%) | Maleic Acid Concentration, (%) | Solution (pH) | Solution Temperature, (°F.) | Sulfide Present in Scrub Solution, (ppm) | Total Sulfide Present in Acidic Solution & Scrub Solution, (ppm) | Iron Content of Acidic Solution from Iron Sulfide Dissolution (Wt. %) |
|---|---|---|---|---|---|---|---|
| 1 | 4 | 0 | 6.0 | 190 | 849 | 855 | 0.32 |
| 2 | 4 | 1 | 6.0 | 190 | 120 | 120 | 0.38 |
| 3 | 4 | 2 | 6.0 | 190 | 94 | 94 | 0.35 |
| 4 | 8 | 0 | 6.0 | 190 | 2230 | 2234 | 0.68 |
| 5 | 8 | 1 | 6.0 | 190 | 574 | 574 | 0.53 |
| 6 | 8 | 2 | 6.0 | 190 | 262 | 262 | 0.61 |
| 7 | 8 | 3 | 6.0 | 190 | 21 | 22 | 0.54 |

From the results of the tests, it can be seen that the evolution of hydrogen sulfide decreased using the additive of the present invention and excellent results were achieved in ferrous sulfide dissolution.

It is believed that the evolution of hydrogen sulfide gas is prevented by a reaction of the sulfide with the maleic acid to form thiodisuccinic acid and it is, therefore, believed that two moles of maleic acid are required to react with the ferrous sulfide. The amount of the composition of the invention which should be employed in carrying out the process of the invention is, however, not susceptible to precise definitions since the amount of ferrous sulfide will vary from one cleaning job to another. Moreover, in no case is it possible to precisely, or even more than approximately, calculate or estimate the amount of ferrous sulfide which may be present on a given metallic surface which is to be cleaned. The use of amounts of the additive in excess of the stoichiometric amounts described is not harmful to the operation of the invention, except when a point is reached at which the dissolved ferrous sulfide within the composition unsuitably limits the carrying capacity of the composition. This limitation is generally encountered, however, only at a point where the economic considerations have already dictated a limitation to the amount of the additive employed. It has been found that the reaction between the ferrous sulfide and the additive of the invention can be chemically monitored, where the presence or absence of the ferrous sulfide is measured.

Although certain preferred embodiments of the invention have been described herein for illustrative purposes, it will be appreciated that various modifications and innovations of the procedures and compositions recited may be effected without departure from the basic principles which underlie the invention. Changes of this type are, therefore, deemed to lie within the spirit and scope of the invention except as may be necessarily limited by the appended claims or reasonable equivalents thereof.

What is claimed is:

1. A process for reducing hydrogen sulfide gas evolution during dissolution of ferrous sulfide with an aqueous acidic solution comprising contacting said ferrous sulfide with an aqueous acidic solution capable of dissolving said ferrous sulfide containing an additive in an amount sufficient to reduce the evolution of said hydrogen sulfide gas during dissolution of said ferrous sulfide, said additive comprising at least one member selected from the group consisting of maleic acid, maleic anhydride, and the alkali metal and ammonium salts of maleic acid.

2. The process of claim 1 wherein said additive is present in said aqueous acidic solution in an amount in the range of from about 0.1 percent to about 35 percent by weight of said solution.

3. The process of claim 2 wherein said contacting is effected at a temperature in the range from about ambient temperature at about 250° F. and the duration of said contacting is in the range of from about 1 to about 24 hours.

4. The process of claim 1 wherein said aqueous acidic solution is comprised of an acid selected from the group consisting of acetic acid, formic acid, hydroxyacetic acid, ethylenediaminetetraacetic acid, nitrilotriacetic acid, citric acid, hydrochloric acid, sulfuric acid, phosphoric acid and sulfamic acid and mixtures thereof.

5. The process of claim 4 wherein the additive is maleic acid.

6. The process of claim 1 wherein said aqueous acidic solution is further characterized to include an effective amount of a corrosion inhibitor.

7. The process of claim 1 wherein the additive in maleic acid.

8. The process of claim 7 wherein said additive is present in an amount of from about 0.1 percent to about 10 percent by weight of said aqueous acidic solution.

9. The process of claim 8 wherein said contacting is effected at a temperature in the range of from about 75° F. to about 250° F.

10. The process of claim 7 wherein said ferrous sulfide is a deposit on a ferrous metal surface.

11. The process of claim 7 wherein said aqueous acidic solution is an aqueous solution of ethylenediaminetetraacetic acid.

12. The process of claim 11 wherein said ethylenediaminetetraacetic acid is present in an amount of from about 1 percent to about 10 percent by weight of said solution.

13. The process of claim 12 wherein said maleic acid is present in an amount of from about 0.1 percent to about 5 percent by weight of said solution.

14. The process of claim 11 wherein said ethylenediaminetetraacetic acid is present in an amount of from about 4 percent to about 8 percent by weight of said solution and said maleic acid is present in an amount of from about 0.1 percent to about 5 percent by weight of said solution.

15. The process of claim 14 wherein said contacting is effected at a temperature of from about 150° F. to about 200° F. and the duration of said contacting is in the range of from about 6 hours to about 12 hours.

16. The process of claim 1 wherein said additive is present in said aqueous acidic solution in an amount in the range of from about 0.1 percent to about 15 percent by weight of said solution.

* * * * *